US009909798B2

(12) United States Patent
Tansley

(10) Patent No.: US 9,909,798 B2
(45) Date of Patent: Mar. 6, 2018

(54) COOLING APPARATUS AND METHOD

(71) Applicant: The Sure Chill Company Limited, Tywyn (GB)

(72) Inventor: Ian Tansley, Tywyn (GB)

(73) Assignee: The Sure Chill Company Limited (GB)

( * ) Notice: Subject to any disclaimer, the term of this patent is extended or adjusted under 35 U.S.C. 154(b) by 41 days.

(21) Appl. No.: 14/862,993

(22) Filed: Sep. 23, 2015

(65) Prior Publication Data

US 2016/0116201 A1 Apr. 28, 2016

(30) Foreign Application Priority Data

Sep. 24, 2014 (GB) ..... 1416879.3

(51) Int. Cl.

| | |
|---|---|
| ***F25D 3/08*** | (2006.01) |
| ***F25D 17/02*** | (2006.01) |
| ***F25D 11/00*** | (2006.01) |
| ***F25D 16/00*** | (2006.01) |

(52) U.S. Cl.

CPC ..... *F25D 3/08* (2013.01); *F25D 11/003* (2013.01); *F25D 11/006* (2013.01); *F25D 16/00* (2013.01); *F25D 17/02* (2013.01)

(58) Field of Classification Search

CPC ..... F25D 11/003; F25D 11/006; F25D 17/02; F25D 3/08; F25D 16/00; F25D 5/025; F25D 3/06; F25D 2303/0844; F25D 2303/0843; F25D 2303/0845; F25D 2303/082; F25D 2331/804; F25D 2201/14; F25D 2400/12; G05D 23/192; G05D 23/22; Y02E 60/145

USPC ..... 62/64, 457.2

See application file for complete search history.

(56) References Cited

U.S. PATENT DOCUMENTS

| | | | | |
|---|---|---|---|---|
| 1,441,832 | A | 1/1923 | Collins | |
| 2,525,709 | A * | 10/1950 | Morrison | F25D 31/002 251/117 |
| 3,205,678 | A | 9/1965 | Stoner | |
| 4,319,629 | A | 3/1982 | Hotta | |
| 5,201,194 | A | 4/1993 | Flynn et al. | |
| 2003/0070436 | A1 | 4/2003 | Wood et al. | |
| 2004/0232101 | A1* | 11/2004 | Gardner | B65D 1/0246 215/277 |

(Continued)

OTHER PUBLICATIONS

International Search Report and Written Opinion dated Dec. 16, 2015, for International Patent Application No. PCT/GB2015/052749 filed Sep. 23, 2015.

*Primary Examiner* — Mohammad M Ali
(74) *Attorney, Agent, or Firm* — Perkins Coie LLP

(57) ABSTRACT

Some embodiments of the present disclosure provide for a cooling apparatus comprising: a fluid reservoir for holding fluid to be cooled, the reservoir having a head region and a body region below the head region each arranged to contain fluid to be cooled; and a heat exchange portion arranged in use to be provided in thermal communication with fluid in the body region thereby to allow thermal transfer between the heat exchange portion and fluid in the body region, the apparatus being configured in use to permit cooling means to cool fluid in the head region, wherein the fluid reservoir is arranged such that a cross-sectional area of the reservoir decreases by tapering as a function of distance from the head region to the body region over at least a portion of the distance from the head region to the body region.

16 Claims, 8 Drawing Sheets

(56) References Cited

U.S. PATENT DOCUMENTS

2011/0041546 A1 2/2011 Linder

* cited by examiner

COOLING APPARATUS AND METHOD

CROSS-REFERENCE TO RELATED APPLICATION

This application claims priority to UK Patent Application No. 1416879.3 entitled "COOLING APPARATUS AND METHOD" and filed on Sep. 24, 2014, the contents of which is incorporated herein by reference in its entirety.

TECHNICAL FIELD

The present disclosure relates to a refrigeration apparatus. In particularly, but not exclusively, the disclosure relates to a refrigeration apparatus for use in storing and transporting vaccines, perishable food items, packaged beverages or the like, and for the cooling or temperature control of equipment such as batteries, in the absence of a reliable supply of electricity.

BACKGROUND

A large proportion of the world's population does not have access to a consistent and reliable supply of mains electricity. Underdeveloped countries, or regions remote from populated areas, frequently suffer from rationing of electrical power, often implemented by means of "load shedding", being the creation of intentional power outages, or failures of the distribution network.

The storage of vaccines, food items and beverages at appropriate temperatures is difficult in such areas where this absence of a constant and/or reliable supply of electrical power restricts the widespread use of conventional refrigeration equipment. Vaccines, for example, are required to be stored within a narrow temperature range between approximately 2-8° C., outside of which their viability can be compromised or destroyed. Similar problems arise in connection with the storage of food, particularly perishable food items, and packaged beverages such as canned or bottled drinks.

SUMMARY

Figure 1:
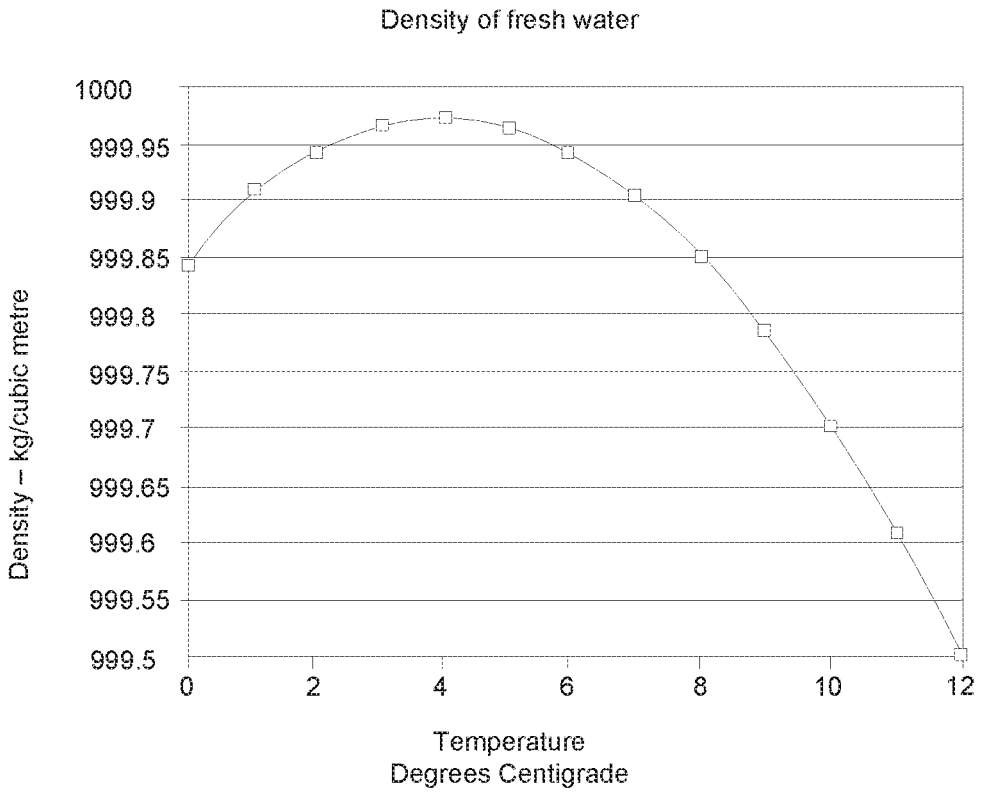
FIG. 1 is a graph illustrating the density of water close to the freezing point.

In one embodiment of the present disclosure, a cooling apparatus includes a fluid reservoir having a head region and a body region located below the head region. Both the head region and body region are arranged to contain fluid to be cooled. The apparatus also includes a heat exchange portion arranged in use to be provided in thermal communication with fluid in the body region thereby to allow thermal transfer between the heat exchange portion and fluid in the body region. The apparatus is configured to permit cooling means to cool fluid in the head region, wherein the fluid reservoir is arranged such that a cross-sectional area of the reservoir decreases by tapering as a function of distance from the head region to the body region over at least a portion of the distance from the head region to the body region.

The cross-sectional area of the reservoir may be defined by a boundary wall of the reservoir. Thus, the cross-sectional area of the reservoir as defined by the boundary wall of the reservoir may decrease by tapering as a function of distance from the head region to the body region over at least a portion of the distance from the head region to the body region. Accordingly, the risk of overcooling of fluid in the body region and therefore the heat exchange portion may be reduced. This is because the amount of heat that may be drawn from the body region towards the head region over a given time is a function at least in part of a cross-sectional area of the reservoir available for thermal or fluid transport. It is to be understood that by providing a taper to the reservoir, the refrigeration apparatus may be made self-regulating with respect to cooling of liquid in the body region.

Under certain circumstances, fluid in the head region may be cooled relatively aggressively such that a front of highly cooled fluid, which may be frozen or substantially frozen fluid, propagates from the head region towards the body region. If the front of highly cooled fluid comes into direct thermal contact with the heat exchange portion in the body region, overcooling of the heat exchange portion may occur, i.e. cooling to too low a temperature. This may result in spoilage of material being cooled by the heat exchange portion, such as medical vaccine. By providing a fluid reservoir that is arranged such that a cross-sectional area of the reservoir decreases as a function of distance from the head region to the heat exchange portion, a speed of propagation of the front of highly cooled fluid may be reduced as the front propagates. It is to be understood that in some embodiments where overcooling results in freezing of the fluid, propagation of a front of frozen fluid may be arrested due to the decrease in cross-sectional area. Propagation of the front of frozen fluid may be arrested a sufficiently large distance from the heat exchange portion that overcooling of the heat exchange portion is prevented.

DETAILED DESCRIPTION

In one embodiment of the present disclosure, a cooling apparatus includes a fluid reservoir having a head region and a body region located below the head region. Both the head region and body region are arranged to contain fluid to be cooled. The apparatus also includes a heat exchange portion arranged in use to be provided in thermal communication with fluid in the body region thereby to allow thermal transfer between the heat exchange portion and fluid in the body region. The apparatus is configured to permit cooling means to cool fluid in the head region, wherein the fluid reservoir is arranged such that a cross-sectional area of the reservoir decreases by tapering as a function of distance from the head region to the body region over at least a portion of the distance from the head region to the body region.

The cross-sectional area of the reservoir may be defined by a boundary wall of the reservoir. Thus, the cross-sectional area of the reservoir as defined by the boundary wall of the reservoir may decrease by tapering as a function of distance from the head region to the body region over at least a portion of the distance from the head region to the body region. Accordingly, the risk of overcooling of fluid in the body region and therefore the heat exchange portion may be reduced. This is because the amount of heat that may be drawn from the body region towards the head region over a given time is a function at least in part of a cross-sectional area of the reservoir available for thermal or fluid transport. It is to be understood that by providing a taper to the reservoir, the refrigeration apparatus may be made self-regulating with respect to cooling of liquid in the body region.

Under certain circumstances, fluid in the head region may be cooled relatively aggressively such that a front of highly cooled fluid, which may be frozen or substantially frozen fluid, propagates from the head region towards the body region. If the front of highly cooled fluid comes into direct thermal contact with the heat exchange portion in the body region, overcooling of the heat exchange portion may occur, i.e. cooling to too low a temperature. This may result in spoilage of material being cooled by the heat exchange portion, such as medical vaccine. By providing a fluid reservoir that is arranged such that a cross-sectional area of the reservoir decreases as a function of distance from the head region to the heat exchange portion, a speed of propagation of the front of highly cooled fluid may be reduced as the front propagates. It is to be understood that in some embodiments where overcooling results in freezing of the fluid, propagation of a front of frozen fluid may be arrested due to the decrease in cross-sectional area. Propagation of the front of frozen fluid may be arrested a sufficiently large distance from the heat exchange portion that overcooling of the heat exchange portion is prevented.

If a fluid is provided in the fluid reservoir that has a negative to positive critical temperature of thermal expansion such as water, being a temperature above which the fluid exhibits a positive coefficient of thermal expansion and below which the fluid exhibits a negative coefficient of thermal expansion, then the apparatus may be operable to maintain fluid in the fluid reservoir at a given depth below the head region (within the body region) at a substantially constant temperature that is at least in part dependent on the negative to positive critical temperature.

In some embodiments a temperature of fluid in the head region is cooled by the cooling means and approaches the critical temperature at which a density of the fluid is a maximum. This causes the fluid to become less buoyant and to sink. In contrast as the temperature of fluid rises above the critical temperature, due for example to thermal exchange with the heat exchange portion, the density of the fluid decreases and the fluid, being more buoyant, tends to rise. Rising fluid at a temperature above the critical temperature may therefore mix with sinking fluid, and ultimately a substantially static equilibrium may be established in some arrangements. Fluid in the head region that is cooled below the critical temperature has a density less than fluid at the critical temperature and therefore tends not to sink below the head region. Thus the temperature of fluid in the body region below the head region can be arranged in some embodiments not to rise substantially above the critical temperature or to fall substantially below the critical temperature.

In some embodiments, the critical temperature is in the range from −100° C. to +50° C. In some embodiments, the critical temperature is in the range from −50° C. to 10° C. In some embodiments, the critical temperature is in the range from −20° C. to around 8° C. In some embodiments, the critical temperature is in the range from −20° C. to 5° C. In some embodiments, the critical temperature is in the range from −5° C. to 5° C. In some embodiments, the critical temperature is in the range from 2° C. to 5° C. Other values for the critical temperature may be useful in other embodiments.

The term "cold pack" is understood to mean a body of coolant contained within a sealed package, such as an icepack. The package may comprise a plastics material. The coolant may comprise water, a water/salt mixture such as a water/salt solution, a water/solvent mixture, a gel, or any other suitable coolant. As noted above, frozen coolant in loose form such as blocks, granules, 'ice cubes', crushed frozen coolant or any other suitable form may also be used.

Some embodiments of the present disclosure allow cooling apparatus to be provided that is driven by a cooling object such as a cold pack or loose frozen material such as water ice or dry ice (frozen carbon dioxide) provided in a cold store portion as described below. The cooling object drives cooling of fluid in the fluid reservoir in an upper (head) region thereof.

Optionally, the fluid reservoir is arranged such that a cross-sectional area of the reservoir decreases by tapering in a substantially continuous manner.

Optionally, the fluid reservoir is arranged such that a cross-sectional area of the reservoir decreases by tapering at least in part in a plurality of substantially discrete steps.

The fluid reservoir may be arranged such that a cross-sectional area of the reservoir decreases by tapering over this portion of the length of the reservoir substantially only in a plurality of substantially discrete steps.

Optionally, a cross-sectional area of the reservoir decreases by tapering as a function of distance from the head region to the body region over a plurality of portions of the reservoir, a cross-sectional area of the reservoir increasing between respective portions such that the cross-sectional area alternately decreases in a tapered manner before increasing again and subsequently decreasing in a tapering manner.

Optionally the increase in cross-sectional area between a pair of adjacent sections is also in a tapered manner. Alternatively the increase may be substantially abrupt.

Optionally, the fluid reservoir is arranged such that a geometric center of a cross-sectional area of the reservoir curves downwardly with respect to an in-use orientation over at least a portion of a length of the reservoir from the head region towards the body region. It is to be understood that by geometric center is meant a centroid of the fluid reservoir.

Optionally, the cross-sectional area of the reservoir decreases as a function of distance from the head region to the body region over said at least a portion of the reservoir that curves downwardly.

Optionally, the apparatus is configured to permit cooling means to cool fluid in the head region by conduction through a heat exchange portion.

The heat exchange portion may comprise a portion of a wall defining an internal volume of the fluid reservoir. The heat exchange portion may be provided by a substantially upright wall.

Optionally, the apparatus comprises a cold store portion, the cold store portion being arranged in use to cause cooling of fluid in the head region by conduction through the heat exchange portion.

Optionally, the cold store portion comprises a compartment arranged having an opening and a closure portion for closing the opening, the cold store portion being arranged to receive coolant for cooling the heat exchange portion.

Optionally, the cold store portion is arranged to receive coolant provided in the form of cold packs or substantially loose frozen material.

Optionally, the apparatus comprises a powered cooling element for cooling coolant in the cold store portion.

By powered cooling element is meant a cooling element such as a refrigeration element requiring a source of energy in order to provide cooling. The source of energy may be electrical energy from a power source such as a battery or external supply, chemical energy, for example from an endothermic chemical reaction, a fuel, such as a gas or liquid fuel, or any other suitable energy source.

In some embodiments, the cold store portion is not a portion that is intended to be filled with liquid, and operation of the apparatus does not require that this is the case. The cold store portion may be considered to be a dry storage portion in some embodiments, although it may become at least partially filled with liquid due to condensation or melting of loose frozen coolant such as ice.

Drain means may be provided for allowing any liquid in the cold store portion to drain from the cold store portion, optionally during use of the apparatus.

The cold store heat exchange portion may comprise a cold store heat exchange element configured in use to be provided in substantially direct thermal contact with a cooling object such as a cold pack in the cold store portion.

In some embodiments the cold store heat exchange element may be provided in direct physical (touching) contact with a cooling object.

The cold store heat exchange element may comprise a metallic element, formed from a metal having a relatively high thermal conductivity such as copper or aluminum. The element may be formed from a ferrous metal such as a stainless steel having inherent corrosion resistance and/or a corrosion resistant coating such as a waterproof paint or other coating.

The cold store heat exchange portion may be provided in substantially direct thermal contact with a wall defining a boundary of the cold store portion. The wall may in addition provide a wall of the reservoir. The wall may be arranged to allow conduction of heat through the wall from fluid in the head region to the cold store heat exchange portion.

It is to be understood that substantially direct thermal contact with the cold store heat exchange element includes direct physical (touching) contact and direct contact via fixing means such as a weld or a fixing element such as a bolt, a rivet or other fixing element. One or more intermediate elements may be provided such as a washer, a gasket or other suitable member intermediate the cold store heat exchange element and the wall of the reservoir.

In some embodiments, the cold store heat exchange element may be arranged to extend to a lower region of the cold store portion such that in use the heat exchange element may be in thermal contact with a cooling object resting on a basal surface of the cold store portion.

The cold store portion may be sized to receive a plurality of cold packs.

In some embodiments, the apparatus may comprise resilient urging means for maintaining a cooling object in substantially direct thermal contact with the cold store heat exchange portion. This feature has the advantage that a change in volume of a cooling object due to warming thereof in use may be accommodated by the resilient urging means such that a cooling article that is initially in substantially direct thermal contact with the cold store heat exchange portion does not move out of such contact during warming. For example, in the case the cooling article is a cold pack that shrinks (or expands) on warming, the cooling article may be maintained in contact with the cold store heat exchange portion even as it shrinks or expands.

The urging means may comprise a resilient member and a cooling object contact portion, the resilient member being arranged to cause the contact portion to apply a force to a cooling object to urge the cooling object in a direction toward the cold store heat exchange portion.

The contact portion may form part of the resilient member, for example a free end thereof. This feature may be advantageous in reducing a risk of seizure of the resilient member due to formation of frozen water ice thereon, for example due to freezing of condensed water vapor.

Where a plurality of cold packs are provided side by side in the cold store portion, the resilient urging means may apply a force to one cold pack that is transmitted to a cold pack nearest the cold store heat exchange portion to maintain that cold pack in substantially direct thermal contact with the cold store heat exchange portion.

In some embodiments, the contact portion may be movable such that the resilient urging means is operable to accommodate different numbers of cooling articles.

In some embodiments, the resilient urging means is formed to be of relatively high thermal conductivity whilst in some alternative embodiments the resilient urging means is formed to be of relatively low thermal conductivity.

In some embodiments the resilient urging means may comprise a resiliently deformable object such as a helical spring, leaf spring or other spring element. In addition or instead the resilient urging means may comprise a resiliently deformable article or material such as a sponge-like material, gas or fluid-filled bladder or any other suitable means. The resilient urging means may be arranged to adapt its shape or size to accommodate variations in the volume or position of one or more cooling articles such as cold packs or loose frozen coolant as the cooling articles change temperature.

In some embodiments, the resilient urging means may be configured to expand when loose frozen coolant melts so as to cause a liquid level of melted coolant to rise as the coolant melts. Frozen coolant may in some systems float at an upper level of the liquid (as in the case of water ice in water due to a lower density of the frozen coolant relative to liquid phase coolant). The resilient urging means may therefore serve the function of causing remaining frozen coolant to be positioned at a higher level within the cold store portion than in the absence of the resilient urging means. This may have the advantage of improving thermal communication between the frozen coolant and fluid in the head region of the reservoir.

It is to be understood when a given volume of frozen water melts, the volume of the water contracts. Resilient urging means in the form of a fluid-filled bladder such as a gas filled bladder may be arranged to cause a level of remaining frozen coolant to remain at a level within the cold store portion that is higher than that which it would otherwise assume in the absence of the resilient urging means. This may assist in reducing an amount of any reduction in cooling of fluid in the head region of the fluid reservoir as frozen coolant in the cold store portion melts.

In some embodiments, the cold store heat exchange portion may be arranged to be in thermal contact with fluid in the head region and not with fluid below the head region of the fluid reservoir.

Thus the cold store heat exchange portion may be arranged to cool directly fluid in the head region and not fluid below the head region. Fluid below the head region may optionally be cooled indirectly by fluid in the head region by conduction of heat from fluid below the head region, through fluid in the head region, to the cold store heat exchange element, or by movement of fluid in the head region to the region below the head region, displacing fluid below the head region upwardly.

Optionally, a thermal resistance of the apparatus to flow of heat from fluid in the fluid reservoir to the cold store portion is higher for fluid below the head region compared with fluid in the head region.

This may be achieved in some embodiments by providing insulation means between the cold store portion and fluid reservoir over an area of a wall of the fluid reservoir between the cold store portion and body region of the fluid reservoir. The insulation means may comprise an insulating material such as an expanded polystyrene material or a solid foam. Alternatively, or in addition, the insulation means may comprise a volume of gas, or an evacuated volume. Other arrangements may be useful in some embodiments.

Optionally the fluid storage reservoir comprises a plurality of fluid cells. Fluid in respective adjacent cells may be separated by at least one cell wall portion, the at least one cell wall portion being arranged to allow transfer of thermal energy between fluid in respective adjacent cells.

One or more of the cells may include a portion of the head region and a portion of the body region of the fluid reservoir.

One or more of the cells may include a volume spanning a distance from substantially the uppermost region of the reservoir to substantially the lowermost region.

Alternatively, or in addition, one or more of the cells may include a volume spanning a width of the reservoir. That is, a lateral dimension of the reservoir.

One or more of the cells may be stacked one above the other with respect to a normal upright orientation of the apparatus. A plurality of cells may be provided in the form of a column that runs from the head region to the body region. A plurality of such columns may be provided.

Optionally, the fluid reservoir contains a thermal fluid having a critical temperature, the critical temperature being a temperature above which the fluid exhibits a positive coefficient of thermal expansion and below which the fluid exhibits a negative coefficient of thermal expansion.

That is, as a temperature of the fluid rises from a temperature below the critical temperature to a temperature substantially equal to the critical temperature a density of the fluid increases, whilst as the temperature of the fluid rises above the critical temperature, the density of the fluid decreases.

In some embodiments, the thermal fluid may consist substantially of water. Alternatively the fluid may comprise water with an additive such as a salt, optionally sodium chloride. Thus the fluid may be or comprise a brine in some embodiments. The additive may be or include a solvent such as an alcohol. Other solvents and other additives are also useful. In some embodiments the fluid may be or comprise an oil, or a mixture of oil and one or more other liquids or solids. Other liquids may be useful in some embodiments.

The cooling element may be powered by an electric power supply unit that may comprise a solar electric generator unit arranged to generate electricity from solar energy. Alternatively the refrigeration unit may be fuel fired, optionally gas fired as noted above.

The apparatus may comprise a sensor, the apparatus being operable to interrupt cooling of the cold store portion by the cooling means when a temperature of the sensor falls below a prescribed temperature.

The sensor may be arranged to monitor a temperature of an interior of the cold store portion. The sensor may be located in an upper (or lower) region of the cold store portion.

In some alternative embodiments the sensor may be arranged to monitor a temperature of fluid in the fluid reservoir such as the head region of the fluid reservoir. The sensor may be provided in substantially direct thermal communication with fluid within the reservoir in some embodiments. Optionally the sensor may be at least partially immersed in fluid in the reservoir such as the head region of the reservoir.

The sensor may be disposed to detect the formation of solidified fluid, optionally ice in the fluid reservoir in the case the reservoir contains a fluid comprising water. The sensor for detecting solidified fluid may be a temperature sensor; the apparatus may be arranged to determine that solidified fluid is present when the temperature measured by the sensor falls below a prescribed value, optionally 1°-2° Celsius, further optionally below 4° Celsius, still further optionally below 3° Celsius. Other values are also useful.

The sensor may be disposed a sufficient distance from the cold store heat exchange portion to allow a sufficiently large volume of fluid in the head region of the reservoir to be cooled to a sufficiently low temperature before interrupting operation of the refrigeration unit.

Methods of detecting formation of a frozen body other than thermal measurements may also be useful. For example, interference of frozen fluid with a mechanical device such as a rotating vane may be a useful means for detection of frozen fluid in some embodiments. Furthermore, a change in volume of the fluid (including frozen fluid) within the fluid reservoir may be a useful measure of the presence of frozen fluid, for example an increase in the volume such the volume exceeds a prescribed amount may indicate that a sufficiently large volume of frozen fluid has been formed.

In embodiments in which solidification of fluid does not take place below the critical temperature in the operation range of the apparatus, the temperature sensor may be arranged to detect when a volume of fluid below a set temperature value has grown sufficiently large substantially to contact the temperature sensor, at which point operation of the cooling means may be interrupted.

It is to be understood that once the temperature detected by the sensor has risen above a set value, operation of the refrigeration unit may be resumed. A suitable time delay for example due to hysteresis in the control system may be introduced to prevent switching on and off of the cooling means at too high a frequency. Alternatively the temperature at which the refrigeration unit resumes operation may be higher than that below which it terminates operation by an amount sufficient to prevent switching on and off of the cooling means at too high a frequency.

In typical powered embodiments, the refrigeration unit may include an electrically-powered compressor. However, refrigeration units using other refrigeration technology may also be useful. One example of such alternative technology is a Stirling engine cooler. The Stirling engine cooler may be arranged to be operated in a solar direct drive mode.

The cold store portion and fluid reservoir may be provided in a side by side configuration.

Optionally the cold store portion and fluid reservoir are substantially vertically coextensive.

Optionally, the heat exchange portion is configured to absorb heat from a payload volume for containing an object or item to be cooled, the payload volume being defined at least in part by a payload container.

In an embodiment, the payload volume may comprise one or more shelves for supporting items or objects to be cooled. The payload volume may be open fronted. Alternatively, the payload volume may comprise a closure such as a door for thermal insulation thereof. The door may be arranged to allow access into the payload volume from above the volume. Alternatively or in addition the door may allow access into the payload volume from a front or side of the payload volume.

Optionally, the payload volume is arranged to support an item at an angle in the range of from around 30 degrees to around 80 degrees to a horizontal plane.

Optionally the payload volume is arranged to support an item at an angle in the range of from around 40° C. to around 60° C.

It is to be understood that by supporting an item at a non-normal angle to the horizontal, the item, such as a bottle or vial, can lie such that it cannot topple. The angle may be arranged such that it is sufficiently large to prevent liquid in the bottle or vial from contacting a closure seal such as a cap or lid, thereby reducing a risk of leakage of fluid. The payload volume may support an item against a basal surface of the payload container, the basal surface being arranged to be cooled by the fluid reservoir thereby to cool the payload volume.

Alternatively or in addition, the payload volume may comprise at least one receptacle within which an article such as a container such as a beverage container, a fruit or any other suitable article can be placed for temperature-controlled storage, the or each receptacle may comprise a tube or pouch having an opening defined by an aperture disposed in a wall of the fluid reservoir and extending inwardly into the cooling region so as to be submerged therein.

The or each tube or pouch may be closed at its end distal from the opening.

The or each receptacle may be formed from a flexible material, optionally a resilient flexible material such as an elastomeric material.

The or each receptacle may taper from its end proximal to the opening towards its end distal to the opening. Alternatively each receptacle may include substantially parallel walls, for example a cylindrical tube of substantially constant diameter along at least a portion of a length thereof, optionally substantially the entire length thereof.

The apparatus may comprise at least two receptacles, the end of each receptacle distal to its respective opening being connected.

The heat exchange portion of the apparatus may comprise one or more fluid pipelines through which a fluid to be cooled flows, in use. The pipeline may be arranged to flow through the fluid reservoir.

Optionally, in some embodiments, a pipeline may be arranged to flow through the cold store portion.

The pipeline may be a pipeline for a beverage dispensing apparatus. The apparatus may be configured whereby beverage to be dispensed is passed through the pipeline, optionally by means of a pump and/or under gravity.

In an embodiment, the payload volume may be arranged to contain one or more articles such as one or more batteries. The batteries may be arranged to be cooled by the apparatus whilst the batteries are being charged and/or whilst the batteries are discharging current. The apparatus may form part of a telecommunications installation and be arranged to power one or more items of telecommunications equipment such as a transmitter, a receiver, a transceiver or the like.

The heat exchange portion may be arranged to be fed with fluid from the body region of the fluid reservoir via a conduit or pipeline. Fluid from the fluid reservoir may be arranged to circulate from the fluid reservoir, through the article heat exchange portion and back to the fluid reservoir.

The apparatus may comprise means for passing air over or through the heat exchange portion towards, onto or around an article to be cooled.

In an embodiment, the apparatus is configured to be disposed within a conventional refrigerator or the like. In this embodiment, the cooling means may comprise the existing cooling element of the refrigerator. The apparatus may be arranged to be positioned within the refrigerator such that the head region of the fluid reservoir is in thermal communication with the existing cooling element so as to cool the fluid therein.

The apparatus may for example be in the form of a structure formed to fit within a conventional refrigerator. The apparatus may be molded or otherwise formed to fit within a conventional refrigerator.

Optionally, the cooling means includes a powered cooling element configured to cool fluid in the head region. In some embodiments the powered cooling element configured to cool fluid in the head region may be configured to cool fluid in the head region via a heat exchange portion; the heat exchange portion may be comprised by the reservoir, for example by a portion of a wall retaining fluid in the reservoir. In some embodiments the powered cooling element may be at least partially immersed in fluid in the head region. In some embodiments a heat exchange portion may be provided that is at least partially immersed in fluid in the head region, the heat exchange portion being cooled by the cooling element.

Optionally, the cooling element is at least partially immersed in fluid in the head region, in use.

Optionally, the cooling element is configured to cool a heat exchange portion that is at least partially immersed in fluid in the head region, in use.

In a further aspect of the present disclosure there is provided a method of cooling by cooling apparatus comprising, cooling, by cooling means, a fluid in a head region of a fluid reservoir, the fluid reservoir having a body region below the head region. The method continues with drawing heat from a heat exchange portion into the fluid in the body region and causing thermal transport through the fluid reservoir along a thermal flow path from the body region to the head region as a consequence of cooling fluid in the head region. The method includes causing thermal transport to take place over a cross-sectional area of the reservoir that decreases by tapering as a function of distance from the head region to the body region over at least a portion of the distance from the head region to the body region. In other words, the method includes causing thermal transport to take place over an area that increases in an inverse-tapering manner over at least a portion of a distance from the body region to the head region. Thus, a cross-sectional area of the reservoir may increase as a function of distance over at least a portion of a thermal flow path from the body region to the head region.

The method may further comprise cooling by cooling means fluid in the head region by means of a cooling media provided in thermal communication with fluid in the head region.

The method may further comprise providing at least one cooling object in a cold store portion of the cooling apparatus, whereby the at least one cooling object is in thermal communication with a cold store heat exchange portion that is in turn in thermal communication with fluid in the head region.

Optionally, cooling fluid in the head region comprises cooling a thermal fluid having a critical temperature, the critical temperature being a temperature above which the fluid exhibits a positive coefficient of thermal expansion and below which the fluid exhibits a negative coefficient of thermal expansion.

The method may further comprise cooling thermal fluid in the head region by means of the heat exchange portion to a temperature at or below the critical temperature.

In an aspect of the invention for which protection is sought there is provided a cooling apparatus including a cold store portion for storing at least one cooling object, a fluid reservoir for holding fluid to be cooled, the reservoir having a head region and a body region below the head region each arranged to contain fluid to be cooled, and a cold store heat exchange portion arranged in use to be provided in thermal communication with a cooling object in the cold store portion and a fluid in the head region of the fluid reservoir. Optionally, the cold store heat exchange portion is arranged in use to be provided in substantially direct thermal contact with a cooling object in the cold store portion.

Embodiments of the present invention allow cooling apparatus to be provided that is driven by a cooling object such as a cold pack or loose frozen material such as water ice or dry ice (frozen carbon dioxide) provided in the cold store portion. The cooling object drives cooling of fluid in the fluid reservoir in an upper (head) region thereof.

The cold store heat exchange portion may comprise a portion of a wall of the fluid reservoir.

It is to be understood that the term "wall" of fluid reservoir is meant to include a portion defining a boundary of the reservoir and arranged to retain fluid within the reservoir.

It is to be understood that by critical temperature is meant a temperature at which a maxima in fluid density as a function of temperature is observed. Thus, the density of the fluid increases as its temperature rises towards the critical temperature and then decreases as the temperature rises above the critical temperature, meaning that its density is at its maximum at the critical temperature.

It is to be understood that the pack storage portion is arranged, in use, to cool fluid in the head region of the fluid reservoir.

Within the following description, as far as possible, like reference numerals indicate like parts.

It will be understood from the foregoing that embodiments of the present disclosure rely upon one of the well-known anomalous properties of certain fluids such as water: namely, that its density is a maximum at a critical temperature. The temperature coefficient of thermal expansion of the fluid is positive above the critical temperature and negative below the critical temperature. This phenomenon is illustrated in FIG. 1 where the density of water is plotted as a function of temperature. The critical temperature of water can be seen to be approximately 4° C. Reference to water as an example of a fluid that may be employed in some embodiments will be used herein, but it is to be understood that other fluids having a similar property in respect of temperature coefficient of thermal expansion may also be useful. Fluids comprising water and one or more additions may be useful, such as water and a salt. The salt may allow the critical temperature to be lowered. Other additives may be useful for lowering or raising the critical temperature of water, or of other fluids. Other fluids such as oils having a critical temperature may be useful in some embodiments.

The fact that water has a maximum in density as a function of temperature at the critical temperature is a consequence of the fact that water has a negative temperature coefficient of thermal expansion below approximately 4° C. and a positive temperature coefficient of thermal expansion above approximately 4° C. Hereinafter, the term "critical temperature" will be used to refer to the temperature at which the density of the fluid is at its maximum, being approximately 4° C. in the case of water, and above and below which the density decreases. In some embodiments a fluid may have a plurality of critical temperatures such that reference to the 'maximum density' may be reference to a particular local maximum density of the fluid.

In the apparatus disclosed in co-pending PCT application PCT/GB2010/051129, a headspace containing a frozen fluid is disposed above a payload space that is immersed in liquid fluid. Embodiments of the present disclosure exploit a similar principle of operation to the apparatus disclosed in PCT/GB2010/051129. However, the present application discloses a refrigeration apparatus that offers improved performance in terms of the prevention of overcooling of a payload container.

Figure 2B:
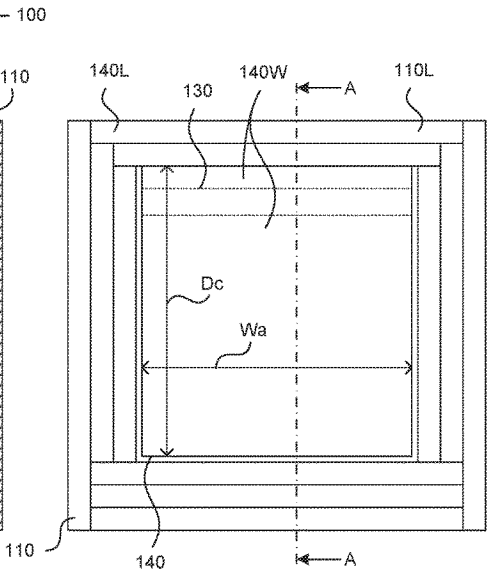
FIG. 2B is a cut-away top view of a cold store compartment of a cooling apparatus, according to various embodiments.
Figure 2A:
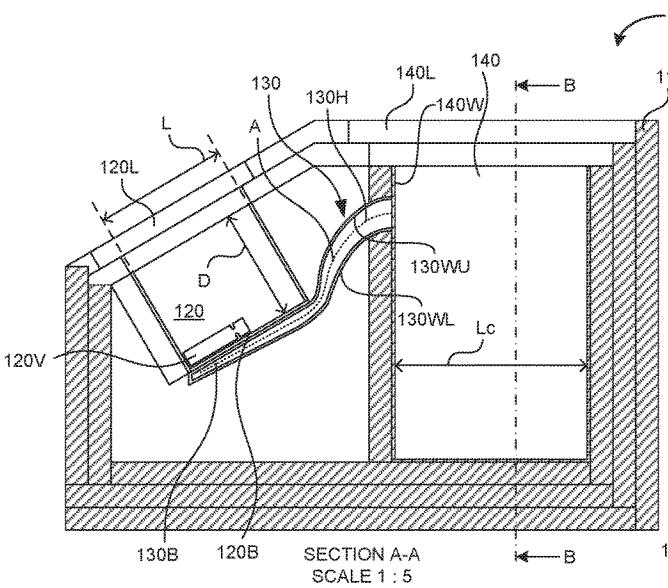
FIG. 2A is a cut-away side view of a cooling apparatus employing the use of a tapered fluid reservoir heat exchanger, according to various embodiments.

Referring firstly to FIG. 2, a refrigeration apparatus, according to some embodiments, is shown generally at 100 in FIGS. 2(*a*) and 2(*b*). FIG. 2(*a*) is a side view of the apparatus 100 whilst FIG. 2(*b*) is a front view.

The apparatus 100 comprises a casing 110 formed from a thermally insulative material to reduce heat transfer into or out of the apparatus 100. For example, the casing 110 may be formed by rotational molding of a plastics material. The casing 110 contains three adjacent volumes: a payload compartment 120, a fluid reservoir 130 and a cold store compartment 140. The cold store compartment 140 is configured to be provided with ice packs or loose ice, for cooling liquid such as water in the fluid reservoir 130.

The payload compartment 120 defines a payload volume that is substantially cuboid in shape. In the embodiment shown the payload volume has a closure in the form of a lid 120L provided in the casing 110. Other closures may be useful in some embodiments such as a hinged door or the like.

The apparatus is arranged to be placed on a floor of a room or on a support such as a table or cart. The payload compartment (and lid 120L) are oriented at an angle of approximately 30 degrees to the horizontal so as to facilitate access to the contents by a user. It is to be understood that by orienting the payload compartment at a non-zero angle to a horizontal plane, the further advantage may be enjoyed that items such as vials of vaccine 120V stored therein may lie substantially flat against a base 120B of the compartment 120 or a shelf, reducing a risk of damage to a vial 120V by toppling during handling by a user, but sufficiently upright to prevent an upper level of liquid in the vial 120V from contacting a closure seal of the vial such as a screw cap or other seal. Thus, a risk of leakage of liquid from a vial 120V may be reduced. It is to be understood that angles other than around 30 degrees may be useful, depending on the level of liquid in a vial 120V, such as 40 degrees, 45 degrees, 50 degrees, 60 degrees, 70 degrees or any other suitable angle.

Insulating material is carried on the lid 120L so that, when it is closed, heat transfer through the lid 120L is reduced. In an alternative embodiment (not shown) the payload compartment 120 may be open-faced, permitting easy access to objects or items stored therein. For example, the payload compartment may comprise a shelving unit for use in retail outlets or shops.

In a still further embodiment, access into the payload compartment may be from directly above the apparatus in the normal upright orientation, i.e. in a substantially vertical direction, or from a side, in a substantially horizontal direction. Other arrangements may also be useful.

In the embodiment shown, the payload volume has a width W of substantially 20 cm, a length L of substantially 15 cm and a depth D of substantially 15 cm. Other dimensions may be useful in some embodiments.

Figure 3A:
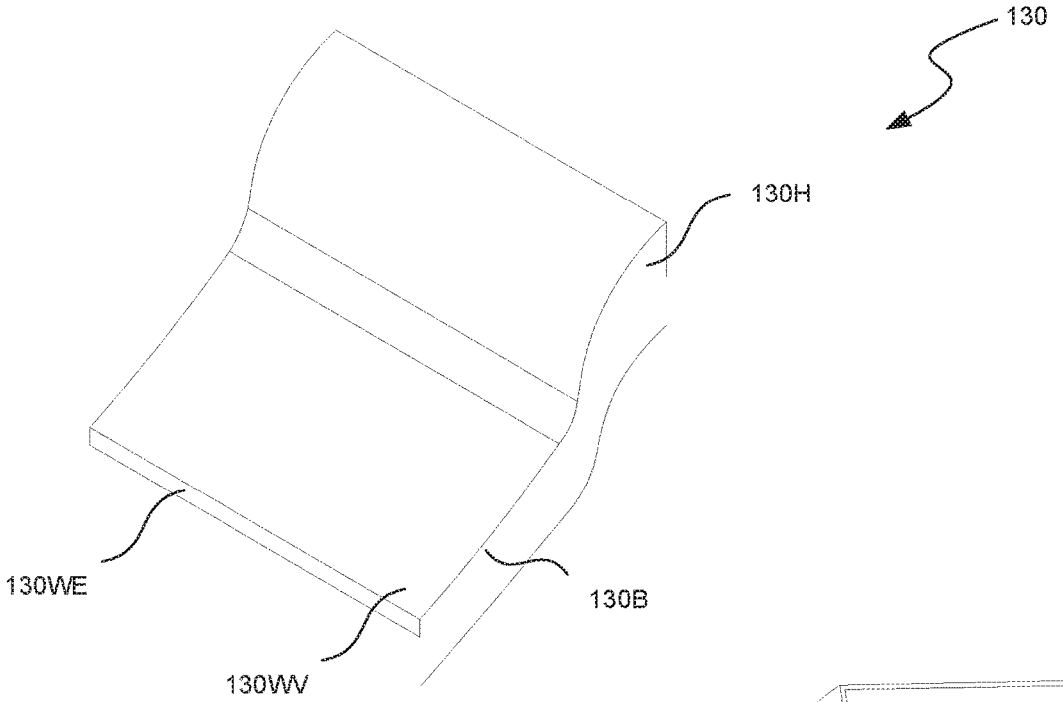
FIG. 3A is an top-down isometric view of a tapered fluid reservoir heat exchanger, according to various embodiments.
Figure 3B:
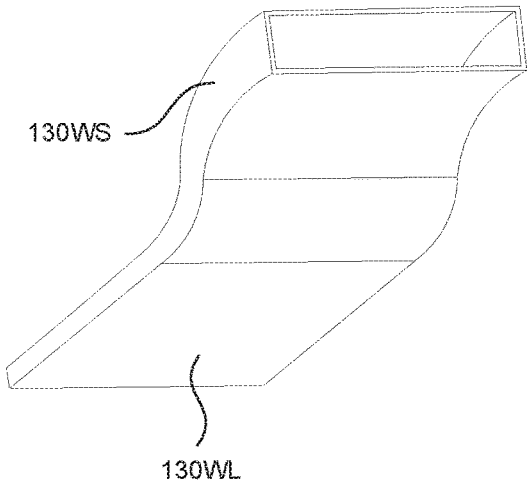
FIG. 3B is an bottom-up isometric view of a tapered fluid reservoir heat exchanger, according to various embodiments.
Figure 3C:
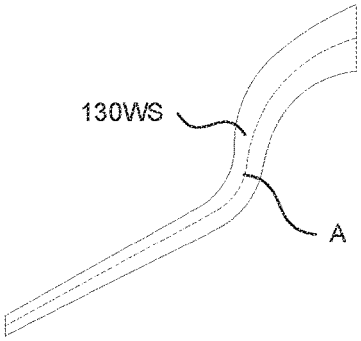
FIG. 3C is a side view of a tapered fluid reservoir heat exchanger, according to various embodiments.

The payload compartment 120 is arranged to overlie the fluid reservoir 130 which is provided in direct thermal contact with the base 120B of the payload compartment 120. The fluid reservoir 130 is shown separately in FIG. 3. FIG. 3(*a*) is a 3D view from above, FIG. 3(*b*) is a 3D view from below, and FIG. 3(*c*) is a side view similar to the orientation of FIG. 2(*a*). The fluid reservoir 130 has a head region 130H located, in the normal upright orientation of FIG. 2(*a*), above a body region 130B. The reservoir 130 has an upper wall 130WU, a lower wall 130WL, two opposed sidewalls 130WS and an end wall 130WE closing a lower end of the body region 130B. The portion of the upper wall 130WU in the body region 130B of the reservoir 130 is provided in abutment with the base 120B of the payload compartment 120.

The reservoir 130 is substantially in the shape of a distorted S-curve as viewed in side or profile view, as per the orientation of FIGS. 2(*a*) and 3(*c*). The distance between the upper and lower walls 130WU, 130WL, and therefore a cross-sectional area of the reservoir with respect to a notional longitudinal axis A thereof as viewed in cross-section, decreases from the head region 130H towards the body region 130B in a tapering manner as described in further detail below. It can be seen from FIG. 2(*a*) that, moving along the notional longitudinal axis A along a length of the reservoir 130 from the head region 130H to the body region 130B, the longitudinal axis A curves downwardly and the cross sectional area tapers until, at a point of inflection, the axis A begins to curve back more sharply towards the horizontal towards the body region 130B. In the body region 130B, the longitudinal axis A of the reservoir 130 is substantially straight, and the cross-sectional area of the reservoir again tapers gradually along the length of the body region 130B. The cross-sectional area with respect to axis A may increase slightly over a portion of a length of the longitudinal axis from the point of inflection towards the body region before tapering within the body region. This feature allows an increase in the volume of fluid within the body region 130H, enhancing stability of the temperature of the payload compartment 120 in the event that a thermal loading is increased, for example when fresh items are placed in the payload compartment 120.

The feature that the longitudinal axis curves downwardly has the advantage that water is able to flow with less restriction than in the presence of relatively abrupt changes in required direction of flow. Relatively sharp edges can cause turbulence for example, increasing resistance to rising and falling of fluid in the reservoir. It is to be understood that, in some embodiments, the more vertical the reservoir, i.e. the less wide the distorted S-shape, the better the performance of the reservoir in terms of cooling of a cooling object by the body region such as a wall of a payload compartment. It is to be understood that if the amount of energy required to transport fluid from the lower region of the body region to the head region is reduced, for example by providing relatively smooth walls to the reservoir, the proportion of energy consumed by the system during operation may be reduced. The relative amount of the reduction may be significant in some embodiments due to the relatively slow rate of movement of fluid in the reservoir. Accordingly, the energy consumed by turbulent flow may be significant enough, in some embodiments, to reduce the heat transfer effect by a non-negligible amount.

The feature that the cross-sectional area gradually tapers has the advantage that a risk of overcooling of fluid in the body region 130B and in turn overcooling of the payload compartment 120 may be reduced. This is because, as the cross-sectional area decreases, the amount of heat that may be drawn from the body region towards the head region over a given time period decreases, reducing the rate of cooling. If fluid in the head region 130H is cooled relatively aggressively a front of highly cooled fluid, which may be frozen or substantially frozen fluid, may propagate from the head region 130H towards the body region 130B. This may result in cooling of fluid in the body region 130B, and in turn the payload compartment 120, below the critical temperature. This may result in spoilage of material being cooled by the heat exchange portion, such as medical vaccine.

By providing a fluid reservoir that is arranged such that a cross-sectional area of the reservoir decreases as a function of distance from the head region to the heat exchange portion, a distance that the front of highly cooled fluid propagates may be reduced. It is to be understood that in some embodiments where overcooling results in freezing of the fluid, propagation of a front of frozen fluid may be arrested a sufficiently large distance from the heat exchange portion that overcooling of the heat exchange portion is substantially prevented.

In the embodiment shown, in the body region 130B of the reservoir 130 the axis A is oriented at an angle of slightly less than 30 degrees to the horizontal so that the upper wall 130WU lies at an angle of substantially 30 degrees to the horizontal. The angle of the axis A is less than 30 degrees by an amount that is substantially half the angle of taper of the upper and lower walls 130WU, 130WL in the body region 130B, such that upper wall 130WU of the reservoir 130 lies substantially parallel to and in thermal contact with the base 120B of the payload compartment 120. As noted above, the base 120B of the payload compartment 1208 is at an angle of substantially 30 degrees to the horizontal in the embodiment of FIG. 2 although other angles may be useful in some embodiments including an angle of substantially zero degrees to the horizontal.

For the present purposes, the longitudinal axis A of the reservoir as viewed in cross-section may be defined as the trace of the midpoint of the shortest line joining the lower wall 130WL of the reservoir 130 to the upper wall 130WU, moving along the upper or lower walls 130UL, 130WL from the head region 130H to the body region 130B. Other definitions may be useful in some embodiments.

The fluid reservoir 130 is formed to have a wall 130WU of sufficiently high thermal conductivity to permit adequate conduction of heat from the payload compartment 120 to fluid within the fluid reservoir 130, in use. In the embodiment illustrated in FIG. 2 and FIG. 3 the walls of the reservoir 130 are formed from a plastics material that is sufficiently thin to provide the required thermal conductivity through the upper wall 130WU of the body region 130B. It is to be understood that one or more walls of the reservoir 130 may be of lower thermal conductivity in regions away from the upper wall 130WU of the body region 130B in some embodiments. In the present embodiment a layer of insulating material is provided on external surfaces of the fluid reservoir 130 that are not in substantially direct contact with the payload compartment 120.

An end of the fluid reservoir 130 defining an end of the head region 130H opposite that at which the body region 130B is located is provided in abutment with an upper end of a substantially upright wall 140W of the cold store compartment 140. Fluid in the head region 130H of the reservoir 130 is in direct contact with the wall 140W in the illustrated embodiment although in some alternative embodiments the reservoir 130 may be provided with a separate wall closing the upper free end. The wall 140W of the cold store compartment 140 is of relatively high thermal conductivity and is cooled by cooling media such as ice packs that may be provided in the cold store compartment 140.

The cold store compartment 140 is sized according to the required interval between successive refreshments of the cooling media provided therein. Accordingly, where longer intervals between successive refreshments are required the cold store compartment 140 may have a larger volume, and therefore capacity for cooling media. In the embodiment shown the cold store compartment 140 has a width Wc of around 60 cm, a depth Dc of around 60 cm and a length Lc of around 40 cm. Other dimensions may be useful in some embodiments. Access to the cold store compartment 140 for insertion and retrieval of cooling media 140 is via a removable lid 140L.

Figure 4:
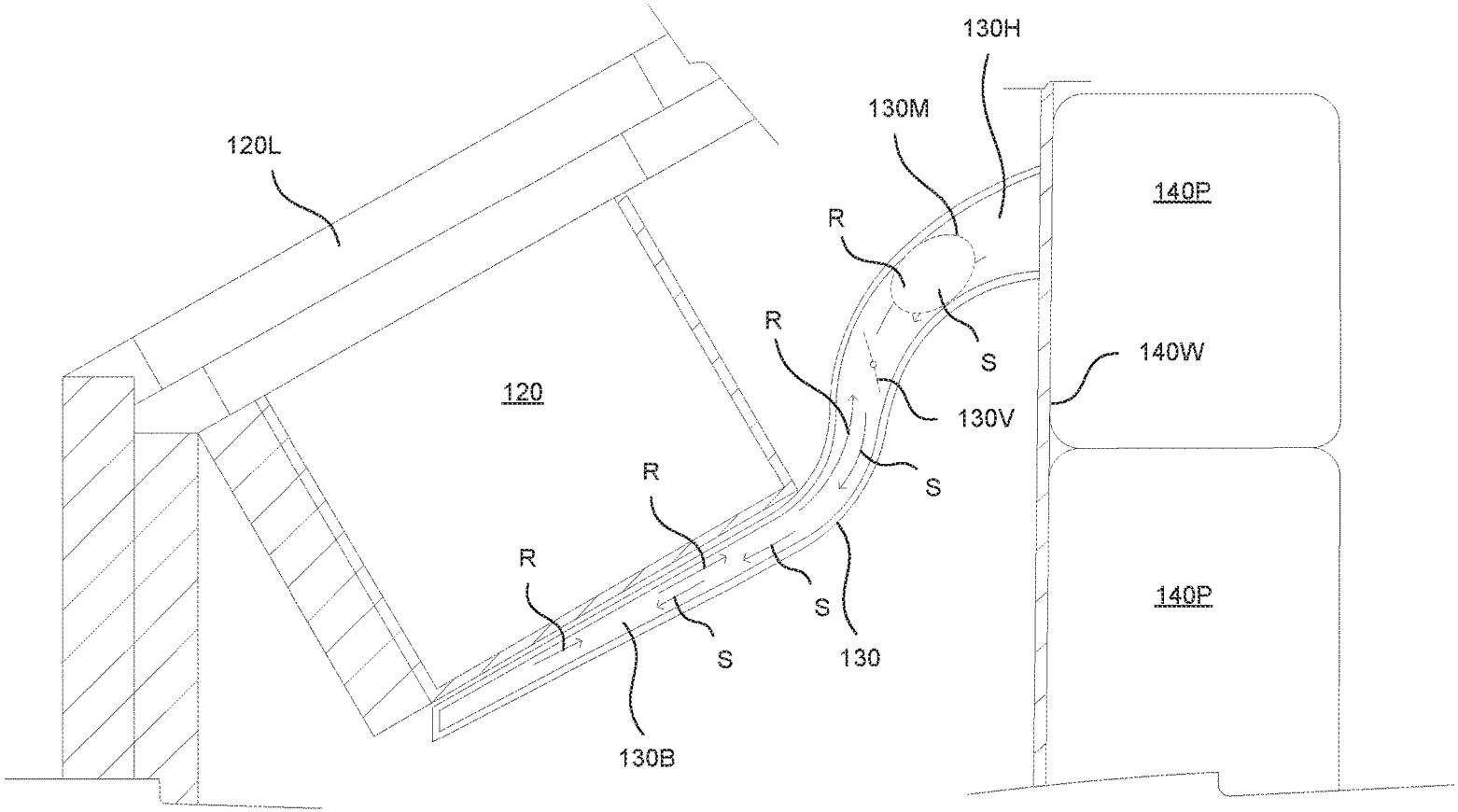
FIG. 4 is a cut-away side view of liquid flow in the tapered fluid reservoir heat exchanger, according to various embodiments

Operation of the refrigeration apparatus of FIG. 2 will now be described. It can be assumed that all of the water in the fluid reservoir 130 is initially at or around the ambient temperature, which may in some environments be in the range from 15 Celsius to 45 Celsius or more. The apparatus 1 is activated by placing cooling media such as cold packs 140P (such as ice packs) in the cold store compartment 140, ideally such that the packs 140P closest to the fluid reservoir 130 are in thermal contact with the upright portion of the wall 140W nearest the fluid reservoir 130 as shown in FIG. 4. In the present embodiment the cold packs 140P are ice packs are in the form of water-tight containers made from a plastics material and containing water having a dye therein which does not change substantially the critical temperature or melting point of the water.

The presence of frozen cold packs 140P in the cold store compartment 140 causes the wall 140W of the cold store compartment 140 to cool, which in turn causes cooling of water in the head region 130H of the fluid reservoir 130 (FIG. 3) by conduction through the wall 140W.

As the water in the head region 130H cools, its density increases. The cooled water thus sinks towards the bottom of the body region 130B of the fluid reservoir as shown schematically by arrows S of FIG. 4, 130 displacing warmer water which rises towards the head region 130H as shown by arrows R. Water rising towards the head region 130H is cooled in the upper region of the reservoir 130 where it may mix with water cooled by conduction of heat out from the head region 130H through the wall 140W of the cold store compartment 140. The upper region of the reservoir 130, optionally including the head region 130H, optionally substantially defined by the head region 130H, may provide a fluid mixing region wherein water cooled by thermal conduction through the wall 140W mixes with rising, warmer water from the body region 130B.

It is to be understood that the rising warmer water R may for example be at a temperature of approximately 10° C. A transfer of heat from the warmer water to the colder water thus occurs within the upper region of the reservoir 130, causing colder water from the head region 130H and the warmer water from the body region 130B to increase and decrease in temperature, respectively, towards the critical temperature. The upper region 130H may therefore be considered to provide a thermal transfer region of the reservoir 130 wherein transfer of heat between fluid from the head and body regions may occur. It is to be understood that if the cold packs 140P are sufficiently cold, ice may form in the head region 130H due to freezing of water in the head region 130H. If the head region 130H becomes substantially filled with ice, the mixing region may move to a region of liquid water below the frozen region.

Because the density of water is at its maximum at the critical temperature, water at this temperature tends to pool at the bottom of the body region 130B of the fluid reservoir 130, displacing lower temperature water towards the head region 130H as described above. This leads to a generally positive temperature gradient being generated within the fluid reservoir 130 with water at the critical temperature lying in the body region 130B and less dense, more buoyant water at temperatures below the critical temperature lying in the head region 130H. It will be appreciated that, over time, most or all of the water contained in the body region 130B of the fluid reservoir 130 is cooled to a temperature of around 4° C.

Water in the fluid reservoir 130 cooled following mixing within the head region 130H pools in the body region 130B of the fluid reservoir 130 which, as described above, is disposed in thermal communication with the payload compartment 120. Heat from the payload compartment 120 is thus absorbed by water in the body region 130B. The temperature of the payload compartment 120, and hence objects or items stored therein, therefore begins to decrease.

To reiterate, in some arrangements water within the head region 130H of the fluid reservoir 130 is typically cooled to temperatures at or below the critical temperature by transfer of thermal energy through the wall 140W of the cold store compartment 140. Water at the critical temperature in the head region 130H sinks and mixes with water above the critical temperature. The average temperature of the water in the region where mixing takes place (which may include or be substantially limited to the head region 130H in some arrangements) approaches the critical temperature as cooling continues, and thus water in the region where mixing takes place sinks into the body region, displacing water above the critical temperature upwardly. One region in which mixing may take place at some time during operation of the apparatus shown in FIG. 4 is indicated at 130M in FIG. 4 by way of non-limiting example.

Over time, this process may approach a steady state situation through the dynamic transfer of heat between water cooled to around the critical temperature in the upper region of the reservoir 130 and water at temperatures above the critical temperature in the body region 130B. In some embodiments, in the steady state water in the head, mixing and body regions 130H, 130M, 130B may become substantially static, thermal transport taking place primarily via conduction.

Through absorption of heat from the payload compartment 120 by the water in the reservoir 130, the payload compartment 120 may be maintained at a desired temperature of approximately 4° C. which is ideal for storing many products including vaccines, food items and beverages.

It is to be understood that in some embodiments the temperature of fluid in the body region 130B under steady state conditions may be adjusted by adjusting a cross sectional area of a flowpath for fluid from the body region 130B to the head region 130H. It is to be understood that by reducing this cross-sectional area, in some embodiments flow of fluid and/or thermal energy may be inhibited, causing the temperature of liquid in the body region 130B to be increased. In some embodiments, in order to achieve this a valve 130V may be provided operable to restrict flow as required. An example of a suitable valve 130V in the form of a butterfly throttle valve is shown in dashed outline in FIG. 4. Other valve means may be useful in some embodiments. In some embodiments the valve means may be arranged to be formed to have a relatively low thermal conductivity, being less than that of the fluid. The thermal conductivity may be sufficiently high to reduce thermal conduction through the reservoir across the valve means in use, relative to thermal conduction through the reservoir 130 in the absence of the valve means.

Once the frozen fluid in the cold store compartment 140 is exhausted, the displacement process, if displacement is occurring in preference to substantially static conduction, may begin to slow but is maintained by the continued absorption of heat from the payload compartment 120 by the water in the body region 130B of the fluid reservoir 130. Due to the high specific heat capacity of water and the volume of water at temperatures below the critical temperature within the head region 130H of the fluid reservoir at least, the temperature of fluid in the body region 130B of the fluid reservoir 130 may remain at or close to 4° C. for a considerable length of time. That is to say, the natural tendency of water at the critical temperature to sink and displace water above or below the critical temperature results in the body region 130B of the fluid reservoir 130 holding water at or around the critical temperature for some time after cold packs 140P in the cold store 140 no longer maintain water in the headspace 130H at or below the critical temperature, enabling the payload compartment 120 to be maintained within an acceptable temperature range for extended periods of time. Some embodiments of the present disclosure are capable of maintaining fluid in the body region 130B at a target temperature for a period of up to several weeks with a fresh charge of frozen cold packs 140P.

Figure 5B:
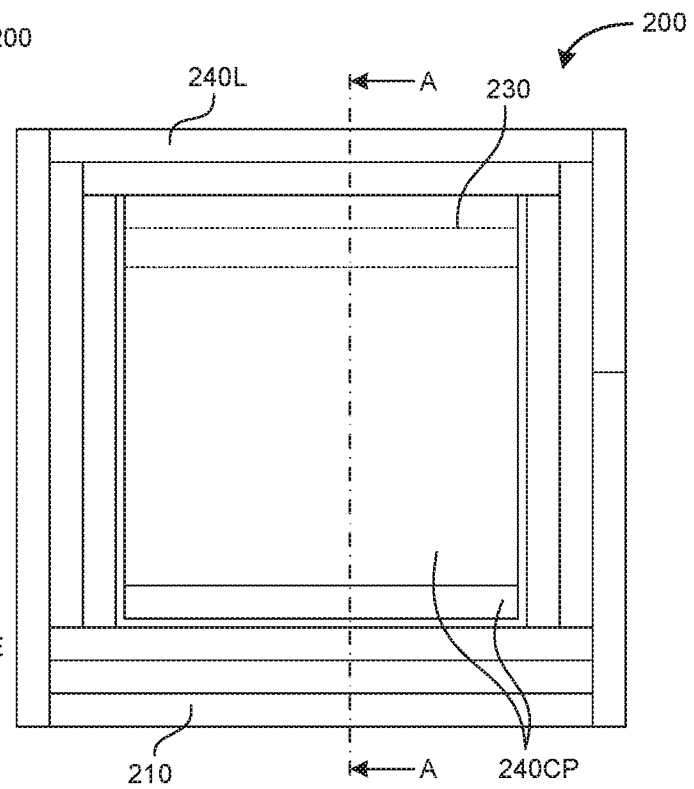
FIG. 5B is a cut-away top view of a sold store employing the use of a conductor plate and an upright bias plate, according to various embodiments.
Figure 5A:
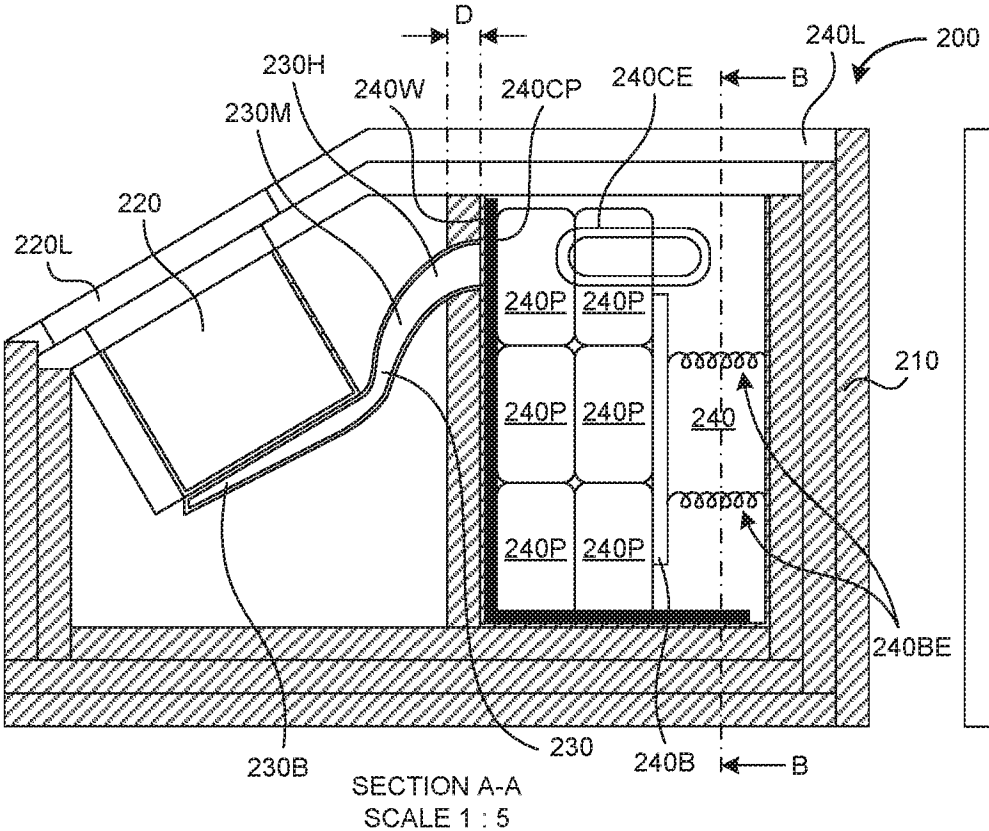
FIG. 5A is a cut-away side view of a cooling apparatus employing the use of a conductor plate and an upright bias plate in the cold store, according to various embodiments.

In some embodiments the cold store compartment 140 may be provided with powered cooling means for cooling the interior of the compartment 140. FIG. 5 illustrates an embodiment of the present disclosure having powered cooling means. Like features of the embodiment of FIG. 5 to those of the embodiment of FIG. 2 to FIG. 4 are shown with like reference signs incremented by 100.

In the embodiment of FIG. 5, a refrigeration apparatus 200 is provided having a payload container or compartment 220, fluid reservoir 230 and a cold store compartment 240. The refrigeration apparatus 100 has a powered cooling element 240CE that is arranged to cool cold packs 240P disposed within the cold store compartment 240. The cold packs 240P in turn cool fluid in the head region 230H of the fluid reservoir 230 in a similar manner to that described above in respect of the apparatus 100 of FIGS. 2 to 4.

It is to be understood that in some embodiments the cooling element 240CE may be arranged to operate substantially continually when power is available, maintaining cold packs 240P provided within the cold store 140 at low temperature.

In the event that the power supply to the cooling element 240CE is interrupted or disconnected, due for example to a power failure, the displacement process described above in respect of cooling of water within the head, mixing and body regions 230H, 230M, 230B of the fluid reservoir 230 may continue if it is occurring, or substantially static conditions may remain, whilst frozen fluid remains in cold packs 240P within the cold store compartment 240 or ice within the head region 230H of the reservoir 230.

Once the frozen fluid is exhausted, the displacement process may begin to slow if it is occurring, but may be maintained by the continued absorption of heat from the payload compartment 220 by the water in the body region 230B of the fluid reservoir 230. As noted above, due to the high specific heat capacity of water and the significant volume of water at temperatures below the critical temperature within the fluid reservoir, the temperature in the body region 230B of the fluid reservoir 230 may remain at or close to 4° C. for a considerable length of time.

In situations in which a substantially static equilibrium is established whilst the cold packs 240P are effecting cooling, for example whilst they still contain frozen coolant, the static equilibrium may be interrupted and a displacement process may be re-established, when the frozen fluid is exhausted.

In the embodiment of FIG. 5 the cold store compartment 240 is provided with a conductor plate 240CP in the form a sheet of metallic material in the form of a substantially L-shaped member. Other shapes may be useful in some embodiments. A lower portion of the conductor plate 240CP rests on a floor of the cold store compartment between the wall 240W and cold packs 240P when present. An upright portion of the plate 240CP is positioned in abutment with the vertical wall of the cold store portion 240. The conductor plate 240CP acts to conduct heat passing through the wall 240W of the cold store compartment from the reservoir 230 to the cold packs 240P.

The cold store compartment 240 is also provided with a substantially upright bias plate 240B that is coupled to resilient biasing elements 240BE mounted against a portion of the wall 240W of the cold store compartment 240 that is opposite the upright portion of the conductor plate 240CP. The bias plate 240B is configured to apply a force to the cold packs 240P to urge the cold packs 240P against a vertical side of the conductor plate 240CP. The presence of the resiliently biased bias plate 240B allows the apparatus to maintain the cold packs 240P in thermal contact with the upright portion of the conductor plate 240CP even if changes in volume of the packs 240P takes place, for example due to melting of fluid contained in the packs 240P. In some embodiments the cold store compartment 240 may be sufficiently large to accommodate stacks of cold packs 240P at least two deep with respect to the upright portion of the conductor plate 240CP. In the illustration of FIG. 5, the cold store compartment 240 is sufficiently large to accommodate stacks of cold packs 240P three deep although as shown the packs 240P are shown stacked only two deep. The bias plate 240B is arranged to be movable over a sufficiently large range of positions to enable pressure to be applied to the cold packs 240P whether they are arranged two deep (as illustrated) or three deep. Thus, if the number of available cold packs 240P is insufficient to provide stacks three deep, stacks two deep may be employed with effective thermal transfer between the cold packs 240P and conductor plate 240P.

It is to be understood that, in some embodiments, a powered cooling element may be provided that is arranged to cool substantially directly fluid in the head region of the reservoir rather than via cooling of cold packs. In some embodiments the cooling element may be provided in thermal contact with the wall 240W of the cold store portion 240. In some embodiments the cooling element may be provided in substantially direct thermal contact with fluid in the reservoir 230, optionally at least partially immersed in the reservoir 230.

Figure 6:
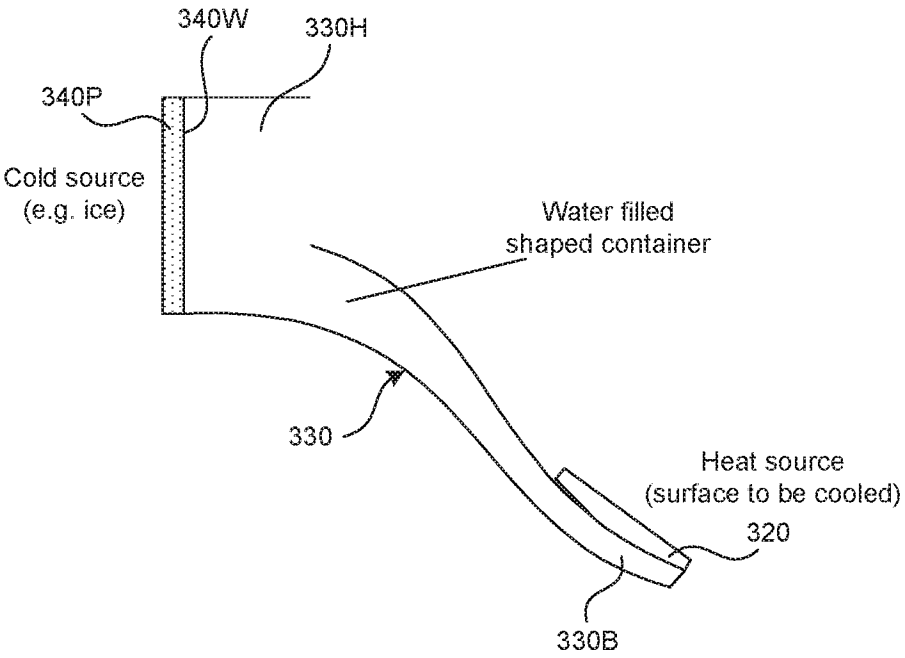
FIG. 6 is a side view of a tapered fluid reservoir heat exchanger including an expanded head region, according to various embodiments.

FIG. 6 is a side view of a reservoir 330 for use in apparatus according to a further embodiment of the disclosure. Like features of the embodiment of FIG. 6 to those of the embodiment of FIG. 5 are shown with like reference signs incremented by 100. The reservoir 330 has a similar shape to the reservoir 230 of the embodiment of FIG. 5 but the head region extends vertically above the curved portion in order to provide an increased volume of the head region.

The reservoir is shown with the head region 330H in thermal communication with a cold pack 340P in the cold store portion of the apparatus via wall 340W of the cold store portion. A lower portion of the body region 330B is similarly in thermal communication with a portion of the payload compartment 320.

Figure 7:
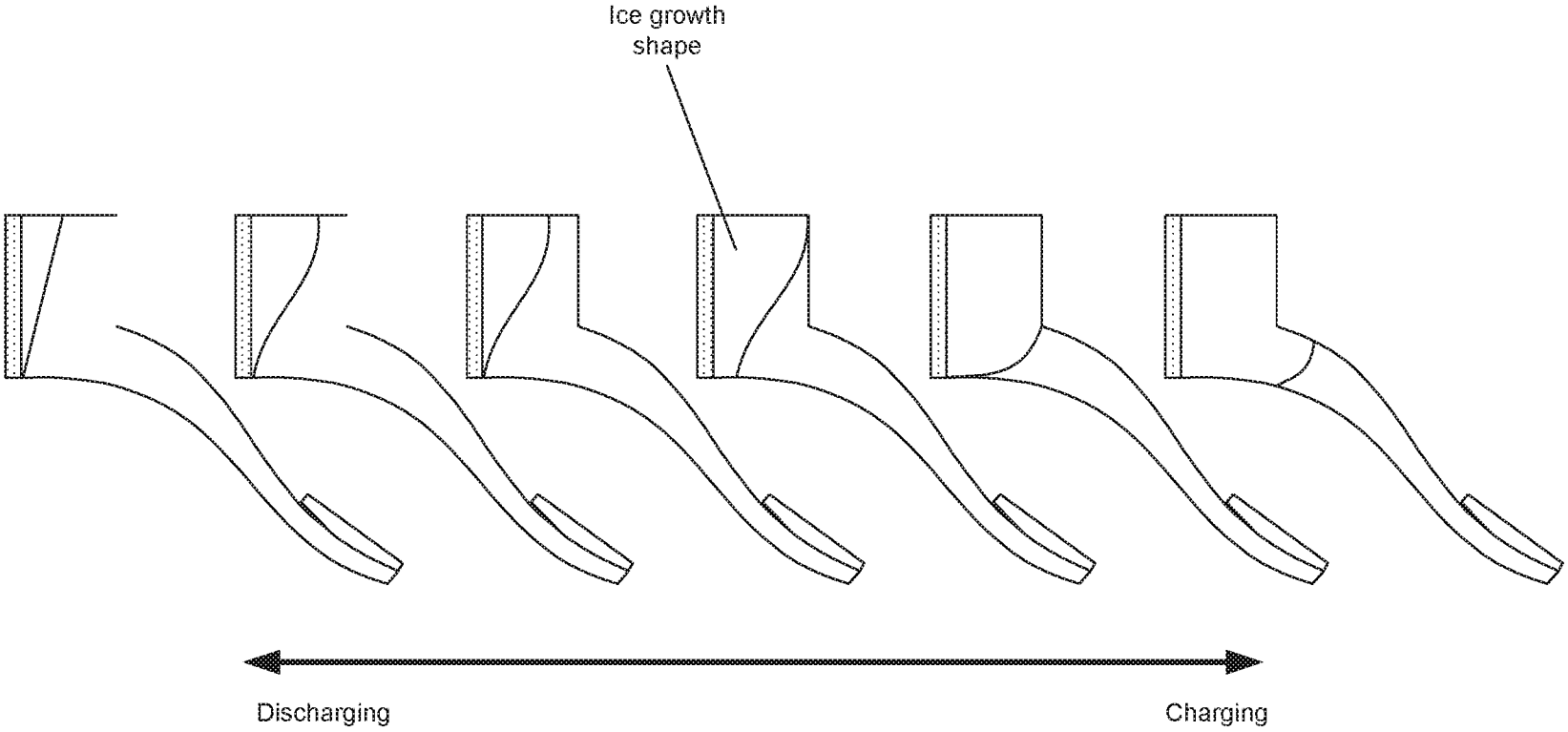
FIG. 7 is continuum diagram of ice growth in the tapered fluid reservoir of FIG. 6.

FIG. 7 show a sequence of images of the reservoir 330 in side view during cooling of fluid in the head region 330H of the reservoir 330 from ambient temperature. In the left-most image, a region of solidified fluid 330SF has formed in contact with the wall 340W of the cold store portion. The volume of the region 330SF is less than 25% of the volume of the head region 330H at the instant shown. Over time, the volume of solidified fluid increases until, as shown in the right most image, substantially all of the fluid in the head region 330H has solidified, and the region of solidified fluid 330SF has begun to propagate through a mixing region 330M towards a lower region of the body region 330B. As discussed in detail above, propagation of the region of solidified fluid 330SF through the body region is restricted at least in part due to the tapered shape of the reservoir 330, reducing overcooling of the lower region of the body region 330B. The process of formation of a region of solidified fluid 330SF may be described as a process of 'charging' of the reservoir 330 since the reservoir 330 becomes 'charged' with solidified fluid and is therefore capable of continuing to function for a certain period of time should continued cooling of the head region 330H be terminated, for example when cold packs in the cold store are exhausted. The solidified fluid 330SF may then begin to melt, causing a reversal of the process of charging of the reservoir 330, which may be described as 'discharging' of the reservoir 330. It is to be understood that continued cooling of the portion of the payload compartment 320 may occur as the process of discharging takes place, until the reservoir 330 is substantially fully discharged.

Figure 8:
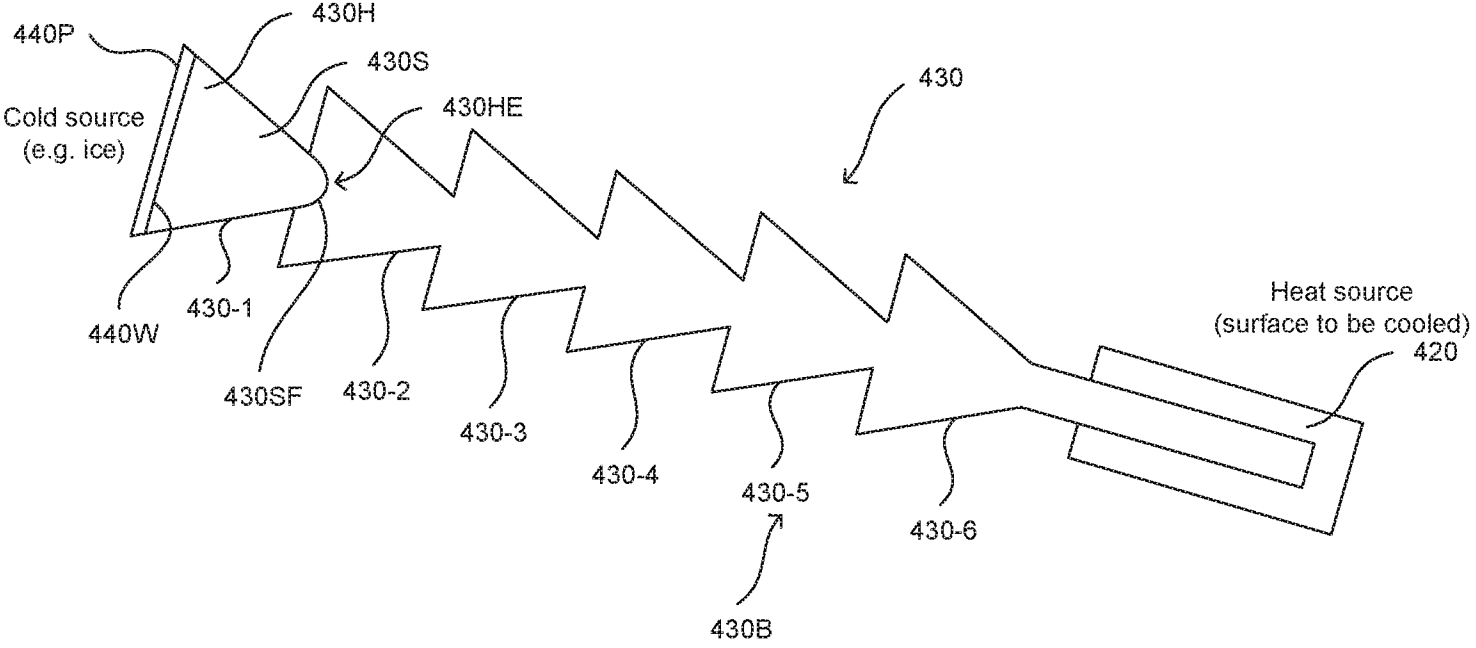
FIG. 8 is a side view of a multi-compartmented tapered fluid reservoir heat exchanger, according to various embodiments.

FIG. 8 is a side view of a reservoir 430 of apparatus according to a further embodiment of the present disclosure. Like features of the embodiment of FIG. 8 to those of the embodiment of FIG. 6 are shown with like reference signs incremented by 100.

The reservoir of 430 FIG. 8 has a head region 430H in thermal communication with a cold pack 440P via a wall 440W at one end of the reservoir. A lower portion of a body region 430B of the reservoir 430 is in thermal contact with a portion of a payload compartment 420. The reservoir 430 may be considered to comprise a number of tapered sections (in the present embodiment, six), labelled 430-1 to 430-6, spanning a length of the reservoir from the wall 440W to the payload compartment 420. The purpose of the tapered sections is to reduce a rate of thermal transfer from the payload compartment 420 to the head region 430H of the reservoir 430 in the manner described above thereby to prevent overcooling of fluid in the reservoir 430. It is to be understood that the presence of a plurality of tapered sections, coupled in series, such that the cross-sectional area of the reservoir alternately tapers in a reducing manner before increasing (whether abruptly, as shown in the embodiment of FIG. 8, or in a tapered manner), has the advantage that thermal transport through the reservoir 430 may be further restricted, reducing a risk of overcooling of the payload compartment 420.

In FIG. 8 a region of solidified fluid 430S is shown, substantially filling head region 430H of the reservoir. A solidified front 430SF of the solidified region 430S is shown propagating into the second tapered section 430-2 of the reservoir 430. It can be seen that thermal energy propagating from the body region 430B to the head region 430H must pass through the region of reduced cross-sectional area at the entrance to the head region 430HE, reducing the rate of thermal transfer for a given temperature difference between the wall 440W and payload compartment 420. It is to be understood that the presence of six tapering sections 430-1 to 430-6 may result in a considerable reduction in rate of propagation of thermal energy.

It is to be understood that some embodiments of the present disclosure may permit a reservoir to be provided that has a smaller fluid volume than some known refrigeration apparatus, for a given required cooling capability of a refrigeration apparatus. It is to be understood that a reservoir with a smaller fluid volume may be advantageous in that it may be of reduced weight when containing sufficient fluid for normal operation. This may enable the reservoir to be filled (to the extent required for normal operations) during manufacture, for example at a factory, rather than requiring to be filled by a user in the field. This may eliminate at least one failure mode of the apparatus, being incorrect filling of the reservoir by an inexperienced user.

Furthermore, reduced fluid volume may provide the advantage that the refrigeration apparatus may be capable of cooling the reservoir to operational temperatures more quickly, due to the reduced thermal mass of the apparatus. Since certain fluids such as water have a relatively high heat capacity, a reduced volume of water may result in a significant decrease in total thermal mass of the apparatus.

The above described embodiments represent advantageous forms of embodiments of the disclosure but are provided by way of example only and are not intended to be limiting. In this respect, it is envisaged that various modifications and/or improvements may be made to embodiments as disclosed while remaining within the scope of the invention as described in the appended claims.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

I claim:

1. An apparatus comprising:

a fluid reservoir configured to hold a water, while in use, the fluid reservoir including:

a body region; and a head region located substantially above the body region, while in use;

wherein the fluid reservoir is arranged such that a cross-sectional area of the fluid reservoir decreases by tapering as a function of distance from the head region to the body region over at least a portion of the distance from the head region to the body region;

a cold store compartment including an interior cold store volume configured to store one or more cold packs, the interior cold store volume defined in part by a first wall made of thermally conductive material, the interior cold store volume in thermal communication with the head region of the fluid reservoir via the first wall; and a payload compartment including an interior payload volume configured to store items to be cooled, the interior payload volume defined in part by a second wall made of thermally conductive material, the interior payload volume in thermal communication with the body region of the fluid reservoir via the second wall;

wherein, in use, water in the head region of the fluid reservoir is cooled by one or more cold packs in the interior cold store volume, via the first wall, to a temperature of maximum density, the cooled water at the temperature of maximum density in the head region is allowed to sink into the body region of the fluid volume under gravity, and items in the interior payload volume are then cooled by the cooled water in the body region of the fluid reservoir via the second wall.

2. The apparatus of claim 1, wherein the fluid reservoir is arranged such that a cross-sectional area of the reservoir decreases by tapering in a substantially continuous manner.

3. The apparatus of claim 1, wherein the fluid reservoir is arranged such that a cross-sectional area of the reservoir decreases by tapering at least in part in a plurality of substantially discrete steps.

4. The apparatus of claim 1, wherein a cross-sectional area of the reservoir decreases by tapering as a function of distance from the head region to the body region over a plurality of portions of the reservoir, a cross-sectional area of the reservoir increasing between respective portions such that the cross-sectional area alternately decreases in a tapered manner before increasing again and subsequently decreasing in a tapering manner.

5. The apparatus of claim 1, wherein the fluid reservoir is arranged such that a geometric center of a cross-sectional area of the reservoir curves downwardly with respect to an in-use orientation over at least a portion of a length of the reservoir from the head region towards the body region.

6. The apparatus of claim 5 wherein the cross-sectional area of the reservoir decreases as a function of distance from the head region to the body region over said at least a portion of the reservoir that curves downwardly.

7. The apparatus of claim 1, wherein the apparatus is configured to permit cooling means to cool fluid in the head region by conduction through a heat exchange portion.

8. The apparatus of claim 1, wherein the cold store portion is arranged to receive coolant provided in the form of cold packs or substantially loose frozen material.

9. The apparatus of claim 1, further comprising a powered cooling element for cooling coolant in the cold store portion.

10. The apparatus claim 1, wherein the fluid reservoir contains a thermal fluid having a critical temperature, the critical temperature being a temperature above which the fluid exhibits a positive coefficient of thermal expansion and below which the fluid exhibits a negative coefficient of thermal expansion.

11. The apparatus of claim 10, wherein the thermal fluid includes water.

12. The apparatus of claim 1, wherein the heat exchange portion is configured to absorb heat from a payload volume for containing an object or item to be cooled, the payload volume being defined at least in part by a payload container.

13. The apparatus of claim 11, wherein the payload volume is arranged to support an item at an angle in a range from 30 degrees to 80 degrees to a horizontal plane.

14. The apparatus of claim 1, wherein the cooling means include a powered cooling element configured to cool fluid in the head region.

15. The apparatus of claim 14, wherein the cooling element is at least partially immersed in fluid in the head region, while in use.

16. The apparatus of claim 14, wherein the cooling element is configured to cool a heat exchange portion that is at least partially immersed in fluid in the head region, while in use.

* * * * *